US005444913A

United States Patent [19]

Nyitray

[11] Patent Number: 5,444,913

[45] Date of Patent: Aug. 29, 1995

[54] LONG SPAN TRUSSED FRAME

[76] Inventor: Z. John Nyitray, 6600 SW. 135 Ter., Miami, Fla. 33156

[21] Appl. No.: 181,455

[22] Filed: Jan. 14, 1994

Related U.S. Application Data

[63] Continuation of Ser. No. 812,407, Dec. 23, 1991, abandoned.

[51] Int. Cl.[6] ..... B21D 39/04; B23P 17/00

[52] U.S. Cl. ..... 29/897.31; 29/446; 29/452; 29/530; 52/223.8; 52/639; 52/691; 52/745.19

[58] Field of Search ..... 52/87, 223.1, 223.8, 52/223.12, 322, 633, 639, 644, 650.1, 691, 724; 264/228; 29/446, 452, 530, 897.31, 897.312, 897.34, 897.35

[56] References Cited

U.S. PATENT DOCUMENTS

| | | | |
|---|---|---|---|
| 2,510,958 | 6/1950 | Coff | 52/223.8 |
| 2,809,074 | 10/1957 | McDonald | 52/639 |
| 3,140,764 | 7/1964 | Cheskin . | |
| 3,260,024 | 7/1966 | Greulich . | |
| 3,323,263 | 6/1967 | Adams . | |
| 3,385,015 | 5/1968 | Hadley | 29/897.34 |
| 3,686,819 | 8/1972 | Atkinson | 52/724 |
| 3,835,607 | 9/1974 | Raaber . | |
| 4,006,523 | 2/1977 | Mauquoy . | |
| 4,144,686 | 3/1979 | Gold . | |
| 4,275,537 | 6/1981 | Pinson | 52/223 L |
| 4,697,397 | 10/1987 | Okuda et al. | 52/223.12 |

FOREIGN PATENT DOCUMENTS

| | | | |
|---|---|---|---|
| 913876 | 9/1946 | France | 52/223.8 |

*Primary Examiner*—Michael Safavi
*Attorney, Agent, or Firm*—Herman J. Hohauser

[57] ABSTRACT

A trussed frame for use in structures and particularly those structures having long-span requirements in which there is at least one compression member comprised of hollow steel filled with high strength concrete forming a composite having a higher load carrying capacity than the total load carrying capacity of the hollow steel compression member and concrete each acting alone and a pre-compressed rolled structure steel tension member having high strength steel post-tension tendons anchored to the trussed frame at the respective ends of the tendon.

3 Claims, 1 Drawing Sheet

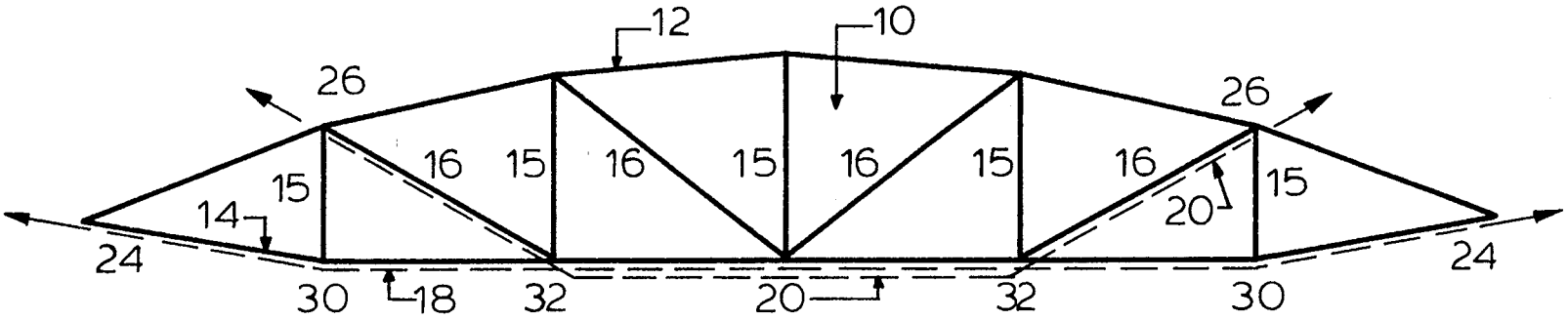
THE FIGURE

LONG SPAN TRUSSED FRAME

This application is a continuation of application Ser. No. 07/812,407, filed 12/23/91, now abandoned.

BACKGROUND OF THE INVENTION

The present invention relates to a trussed frame and the method of constructing the trussed frame and in particular, a trussed frame that can be used in long span applications.

There are various commonly used techniques known to the construction industry in the building of structures, including the use of trussed structures. In designing any structure for construction using any of the known techniques, the issue of load carrying ability must be addressed. The larger the structure, in terms of height or width, the more difficult is the challenge of proper design for dead loads and anticipated superimposed loads.

It is recognized that pre-stressing or post-tensioning structures can increase their load carrying capability. More specifically, trussed structures have been prestressed or post-stressed to increase their total load carrying ability.

The issue of cost of construction is a prime area of concern in the construction of long span structures. It is desirous to provide designs that result in the use of readily available, commercially produced components.

SUMMARY OF THE INVENTION

Accordingly, it is the object of the present invention to provide a simple, but effective unique construction element that can be utilized in a variety of construction environments. Specifically, it is-the object of the present invention to provide a more efficient, cost effective trussed frame for use in structures having long span requirements.

The inventive trussed frame can be used in various applications related to construction including, but not limited to roofs, floors and walls of structures.

It is another object of the present invention to provide a method of constructing and utilizing the trussed frame that reduces the cost of construction as well as resulting in a safer, more efficient construction process.

It is yet another object of the present invention to provide such a new trussed frame and method of constructing such trussed frame from the use of conventional, readily available and/or commercially produced components.

The above stated objectives of the present invention are carried out utilizing a unique combination of well-known components and design techniques.

A trussed-frame is provided that includes in its final ready for use state at least one composite tubular steel/-concrete compression member and at least one pre-compressed steel tension member.

In a preferred form the composite steel/concrete compression chord consists of a hollow, tubular steel member into which high strength concrete is placed. This design results in a compression chord that has a higher load .carrying capacity than the load carrying capacity of the tubular steel member alone added to the load carrying capacity of the high strength concrete alone. The tension members are rolled structural steel shapes to which high strength steel post-tensioning tendons are added. The connections between the compression and tension chords and steel web members are accomplished in a manner well known and accepted in the industry and is not considered as part of the invention.

In the preferred construction of the inventive trussed frame, the steel components thereof are delivered to the site of use and assembled on that site. Thereafter, the concrete is placed in the hollow, tubular shaped compression chord so that a composite action takes place between the steel and concrete. After the concrete attains the desired specified strength, the high strength steel tendons are tensioned IN PREDETERMINED INCREMENTS, in a manner known to those skilled in the art. Such tensioning results in the pre-compressing of the tension components of the trussed frame. *The addition of the post tensioning tendon(s) further increase the load carrying capacity of the tension components. The use of added tendons also provides added safety to the trussed frame as the result of the tendons being anchored to the trussed frame at the ends of each tendon only. This permits each of the multiple tension members to act independently, thereby increasing redundancy within the entire structure and preventing a progressive collapse.

* THE SEQUENCE OF PLACING CONCRETE IN THE HOLLOW COMPRESSION CHORD AND TENSIONING OF STEEL TENDONS MAY BE MODIFIED.

The objectives of the invention are uniquely attained by the use of tubular, composite steel/high-strength concrete compression members, which are extremely efficient for carrying compressive forces, in combination with the use of high-strength steel post-tensioning tendons, which are extremely efficient for carrying tension forces, AND ARE used to supplement tension members.

BRIEF DESCRIPTION OF THE DRAWING

In the drawings:

The FIGURE is a diagrammatic elevational view of the inventive trussed frame.

DETAILED DESCRIPTION OF THE DISCLOSED EMBODIMENT

Referring to the Figure, it can be seen that the inventive trussed frame 10 is composed of a compression chord 12, tension chord 14 and compression and tension web members 15 and 16, respectively. In this disclosure, it will be understood that reference to a trussed frame will mean an individual, flexural, load carrying element of a total structure which is supported externally and which is comprised of individual, linear framing members consisting of a compression chord and a tension chord which are connected by latticed diagonal and/or vertical linear framing members in such a way that the stresses produced in members by the structure's own weight and superimposed loading applied at connection points are predominantly axial compression or tension. High strength steel tendons 18 and 20 are individually attached to trussed frame 10 at tendon anchor points 24 and 26 respectively. The manner of attachment of the tendons to the frame 10 is not a part of the invention and it should be recognized that any conventional technique well known to those skilled in the art can be employed. It should be understood that tendons 18 and 20 can be any known and readily available component such as a single strand of steel or a bundle of individual prestressing strands. The use of a seven (7) wire PRESTRESSING strand is common and can be utilized in this invention. Tendons 18 and 20 each have a break in alignment at tension chord joints 30 and 32 respectively. It should be understood that the phrase =break in alignment" used in this disclosure refers to a deviation in direction in route of a tendon through a circularly curved tube, sleeve, or saddle device which is attached to the trussed frame in such a way as to result in components of the tendon tensile force being resolved into axial loads in the framing which connects to the joint at which the break in alignment occurs. In the preferred embodiment of the invention the compression member 12 is tubular shaped structural steel filled with high strength concrete extending between the two anchor points 24, and tension member 14 is a rolled structural steel member also extending between the two anchor points 24. It is recognized that alternative conventional designs may be employed within the scope of the invention such as various cross-section shaped hollow members for chord 12 and different cross-section shaped structural steel for tension chord 14 and web members 15 and 16.

In practice, frame 10 is assembled and put in place at the site of use before the concrete is placed in member 12 and before the tendons 18 and 20 are attached to trussframe 10. Thereafter, member 12 is filled with concrete. Member 12 may be 25 provided with internal force transfer plates or bars attached to the hollow steel tube at such intervals that both steel and concrete act composite under compressive force. The composite action between the steel tube and the concrete of member 12 results in a higher final load carrying capacity than the load carrying capacity of the steel tube and concrete acting alone. After the concrete attains a predetermined strength, the high strength steel tendons 18 and 20 are tensioned IN PREDETERMINED INCREMENTS, simultaneously pre-compressing and supplementing the tension components of the trussed-frame 10. IN CERTAIN CIRCUMSTANCES THE TENSIONING OF STEEL TENDONS MAY OCCUR, IN PART OR IN ENTIRETY, BEFORE MEMBER 12 IS FILLED WITH CONCRETE. IN THE EVENT THE TENDONS ARE ONLY PARTLY TENSIONED PRIOR TO FILLING MEMBER 12 WITH CONCRETE, THE TENSIONING OF TENDONS IS COMPLETED AFTER THE CONCRETE HAS ATTAINED A PREDETERMINED STRENGTH.

In the preferred embodiment, the pre-compression and supplementing of the tension members are obtained by applying tension to tendon 18 and 20 by means of hydraulic jacks or other conventional tensioning means which jack lies against the end anchorage points 24 and 26.

The principle of the trussed frame and the method of constructing same in the most expedient manner and according to present invention has been disclosed herein in accordance with the provisions of the patent statutes and regulations. It should be understood that the invention as defined in the following claims may be practiced and/or modified in various other ways than as specifically illustrated and described within the scope of these claims.

What is claimed is:

1. A method for constructing a load carrying trussed frame for use in long span structures having the steps of:

a. Providing at least one a hollow, tubular steel compression chord member having internal force transfer means attached thereto at predetermined intervals;

b. Providing a rolled structural shape steel tension chord member;

c. Providing rolled structural steel web members;

d. Connecting said compression chord member, said tension chord member and said web members to form an initial structure of said trussed frame;

e. Attaching each end of at least one high strength steel tendon at predetermined locations onto said trussed frame without attaching any other portions of said high strength steel tendon to said trussed frame;

f. Filling said compression chord member with high strength concrete;

g. Waiting a sufficient time to allow said concrete to attain a predetermined strength and to obtain a composite action with said tubular steel compression chord; and, h. Tensioning said high strength steel tendon in predetermined increments to pre-compress said trussed frame.

2. The method of claim 1 wherein said high strength steel tendon is tightened in a predetermined first increment prior to filling said compression member with said high strength concrete.

3. A method for constructing a load carrying trussed frame for use in long span structures having the steps of:

a. Providing at least one hollow, tubular steel compression chord member having internal force transfer means attached thereto at predetermined intervals;

b. Providing a rolled structural shape steel tension chord member;

c. Providing rolled structural steel web members;

d. Connecting said compression chord member, said tension chord member and said web members to form an initial structure of said trussed frame;

e. Filling said compression chord member with high strength concrete;

f. Attaching each end of at least one high strength steel tendon at predetermined locations onto said trussed frame without attaching any other portions of said high strength steel tendon to said trussed frame;

g. Waiting a sufficient time to allow said concrete to attain a predetermined strength and to obtain a composite action with said tubular steel compression chord; and, h. Tensioning said high strength steel tendon in predetermined increments to pre-compress said trussed frame.

* * * * *